US011820549B2

(12) United States Patent
Jian et al.

(10) Patent No.: US 11,820,549 B2
(45) Date of Patent: Nov. 21, 2023

(54) FOLDABLE CONTAINER

(71) Applicant: HOREN CORTP CO., LTD., Shanghai (CN)

(72) Inventors: Yuanli Jian, Shanghai (CN); Long Feng, Shanghai (CN)

(73) Assignee: HOREN CORTP CO., LTD., Shanghai (CN)

( * ) Notice: Subject to any disclaimer, the term of this patent is extended or adjusted under 35 U.S.C. 154(b) by 116 days.

(21) Appl. No.: 17/434,392

(22) PCT Filed: Feb. 14, 2020

(86) PCT No.: PCT/CN2020/075273
§ 371 (c)(1),
(2) Date: Aug. 26, 2021

(87) PCT Pub. No.: WO2020/173312
PCT Pub. Date: Sep. 3, 2020

(65) Prior Publication Data

US 2022/0041328 A1 Feb. 10, 2022

(30) Foreign Application Priority Data

Feb. 27, 2019 (CN) ..... 201910147351.8

(51) Int. Cl.
*B65D 6/18* (2006.01)

(52) U.S. Cl.
CPC ..... *B65D 11/1833* (2013.01)

(58) Field of Classification Search
CPC ..... B65D 11/18; B65D 2519/00333; B65D 2519/00582; B65D 2519/009; B65D 11/1833
See application file for complete search history.

(56) References Cited

U.S. PATENT DOCUMENTS 5,467,885 A * 11/1995 Blinstrub ..... B65D 25/005 220/6
5,938,059 A 8/1999 Luburic
(Continued)

FOREIGN PATENT DOCUMENTS

CN 103693264 A 4/2014
CN 203568066 U 4/2014
(Continued)

OTHER PUBLICATIONS

The extended European search report issued in European Application No. 20763368.6, dated Nov. 10, 2022, 8 pages provided.
(Continued)

*Primary Examiner* — Stephen J Castellano
(74) *Attorney, Agent, or Firm* — HAMRE, SCHUMANN, MUELLER & LARSON, P.C.

(57) ABSTRACT

A foldable container, comprising a base (1) and two pairs of side plates (2). The two pairs of side plates (2) are hingedly connected to the edges of the base (1) and capable of being folded relative to the base (1). The foldable container further comprises connecting rods (5). Extending portions (21) are provided at the lower edges of at least one pair of the two pairs of side plates (2), protruding portions (13) which extend perpendicular to the base are provided on the corresponding edges of the base (1). The protruding portions are provided with opening portions (11). The opening portions (11) are opened facing the interior of the container and facing upper ends of the protruding portions (13). One end of the connecting rod (5) is pivotally connected to a bottom end of the opening portion (11), and the other end of the connecting rod (5) is slidably and rotatably connected to an upper end of the extending portion (21) in a direction perpendicular to the base. According to the foldable container, the opposite side plates can be conveniently and rapidly placed on the base horizontally by means of simple
(Continued)

and reliable hinging structures, and the foldable container can be made into a thin-walled foldable container.

17 Claims, 17 Drawing Sheets

(56) References Cited

U.S. PATENT DOCUMENTS

| | | | | |
|---|---|---|---|---|
| 2014/0231425 | A1* | 8/2014 | Jian | E05D 3/06 16/369 |
| 2016/0272364 | A1* | 9/2016 | Jian | B65D 19/18 |
| 2017/0341857 | A1 | 11/2017 | Jian et al. | |
| 2018/0327138 | A1 | 11/2018 | Englert et al. | |
| 2020/0122885 | A1* | 4/2020 | Dent | B65D 19/18 |

FOREIGN PATENT DOCUMENTS

| | | | |
|---|---|---|---|
| CN | 104554980 | A | 4/2015 |
| CN | 104944012 | A | 9/2015 |
| CN | 109835570 | A | 6/2019 |
| CN | 210213116 | U | 3/2020 |
| EP | 2620380 | A1 | 7/2013 |
| GB | 2357078 | A | 6/2001 |
| WO | 2010083857 | A1 | 7/2010 |
| WO | 2011134557 | A1 | 11/2011 |

OTHER PUBLICATIONS

International Search Report and Written Opinion issued in PCT/CN2020/075273, dated May 6, 2020, with English translation.

* cited by examiner

FOLDABLE CONTAINER

CROSS REFERENCE TO RELATED APPLICATIONS

This application is the national stage (Rule 371) of international application No. PCT/CN2020/075273 filed 14 Feb. 2020.

This application claims the priority of the Chinese application No. 201910147351.8, filed on Feb. 27, 2019, entitled "FOLDABLE CONTAINER", which is enclosed herewith by reference in its entirety.

TECHNICAL FIELD

This invention relates to a foldable container, in particular to a thin-walled foldable container with a self-restoring hinge.

BACKGROUND OF THE INVENTION

Foldable containers, especially plastic foldable containers, are increasingly used in modern warehousing, logistics, packaging, retail display and other industries because of their recyclable, moisture-resistant, and long-life characteristics, and are gradually replacing wooden and paper containers.

Furthermore, the collapsible feature reduces the recycling and storage space required when the container is empty and saves a lots of related costs. Therefore, the development, manufacture and use of foldable containers can not only save costs for related industries, but are also of great significance to energy conservation and environmental protection.

Take the plastic foldable container as an example, the container generally includes a base and two pair of opposite side plates, and optionally some side plates may also have a small door that can be opened. The lower end of the side plate is rotatably connected to the base through hinge structure. In the initial conventional design, the hinges are fixed hinges, the heights thereof are raised according to the folding sequence of respective side plates, so that the two pairs of side plates can be parallel to each other when folded. However, the disadvantage thereof is that the operator needs to fold or unfold the side plates strictly in accordance with the predetermined sequence, and the shape of each side plate is different, which makes it inconvenient to use and manufacture.

An improved fixed hinge structure is that the heights of the hinges of the two opposite side plates are the same, and the first side plate is folded and inclined downward by a certain angle relative to the base, the second side plate is laid on the first side plate when folded and is parallel to the base surface of the base. The effect thereof is that two side plates are not required to be folded in predetermined sequence, however the side plates cannot be parallel to each other when folded. This solution solves the problems of inconvenience in operation and manufacturing, but the height of the container when folded is not optimal.

This inventor has proposed a novel hinge structure of a foldable container which is disclosed in Chinese patent No. CN201510229497.9. In this patent, a principle similar to a cam mechanism is employed to make the matching surface on the base and the curved contour on the side plate to matched with each other so that the hinge shaft can move up and down vertically during rotation when the side plates are folding or unfolding, and then the side plates can be stacked parallel to each other on the base.

However, the hinge structure of the above-mentioned foldable container has certain limitations, for example, since this structure depends on the matching of the curved contour of the extending portion of the side plates and the mating surface on the groove of the base, which requires that the thickness of the hinge structure thickness is not less than 33 mm, otherwise the component force produced by this structure will cause the side plate to be easily stuck when unfolding. With the continuous improvement of the modern process and material, the foldable container is developing toward lightness and thinness. Therefore, there is a need in this art for a hinge suitable for thin-walled foldable containers.

BRIEF DESCRIPTION OF THE INVENTION

The object of the present invention provides a thin-walled foldable container with a simple structure that can make the container's opposite foldable side plates to be laid flat when folded.

To achieve the above object, the invention provides a foldable container which includes a base, two pairs of side plates which are hinged to edges of the base respectively and is foldable relative to the base and connecting rod. The lower edges of at least one pair of the two pairs of side plates are provided with extending portions, the corresponding edges of the base are provided with protruding portions extending perpendicular to the base, wherein the protruding portions are provided with pockets opening toward the inside of the foldable container and the upper end of the protruding portion. One end of the connecting rod is pivotally connected to the bottom end of the pocket, and the other end is rotatably connected to the upper end of the extending portion and is slidable in a height direction of the extending portion.

In one embodiment, each of the extending portions is provided with a longitudinal slot passing through the thickness thereof and opening toward the bottom end thereof, and the other end of the connecting rod is slidably and rotatably connected to the upper end of the longitudinal slot.

In one embodiment, the foldable container is provided with a plurality of the extending portions spaced apart from each other, a plurality of the pocket spaced apart from each other, and a corresponding number of connecting rods.

Further, the lower edge of at least one of the two pairs of side plates is provided with second extending portion, the protruding portion is provided with second pocket opening toward the inside of the foldable container and the upper end of the protruding portion, wherein the second extending portion is slidably and rotatably connected to the second pocket.

Furthermore, the second extending portion is provided with second longitudinal slot passing through the thickness thereof and opening toward the bottom end thereof, wherein a hinge pin is provided on each of both sides of the bottom end thereof; the second pocket is provided with two elongated opening grooves which are formed on both sides thereof by longitudinally extending rib with a "T" shape in cross section, wherein the hinge pins are respectively received in the two elongated opening grooves.

In one embodiment, the extending portion is provided with a longitudinal slot passing through the thickness thereof and opening toward the bottom end thereof, and the pocket is provided with a corresponding pair of longitudinal ribs;

the width between the opposite surfaces of the pair of longitudinal ribs is less than or equal to the width of the longitudinal slot;

the lower ends of the longitudinal ribs are hinged with one end of the connecting rod and the upper end of the longitudinal slot is slidably and rotatably connected to the other end of the connecting rod.

Preferably, the lower ends of the pair of longitudinal ribs is provided with hinge holes respectively, and one end of the connecting rod is provided with a hinge pin extending from both sides thereof.

Preferably, the longitudinal slot is provided with elongated grooves on both sides at the upper end thereof, and the other end of the connecting rod is provided with hinge pins extending from both sides thereof.

Preferably, the longitudinal groove is provided with hinge pins on both sides at the upper end thereof, and the other end of the connecting rod is provided with elongated grooves on both sides.

Preferably, the lower ends of the pair of longitudinal ribs are provided with hinge holes, the longitudinal slot are provided with elongated grooves on both sides at the upper end thereof respectively, and both ends of the connecting rod are provided with hinge pins extending from both sides thereof.

Preferably, the lower ends of the pair of longitudinal ribs are provided with hinge holes, and the upper end of the longitudinal slot is provided with hinge pins on both sides at the upper end thereof respectively; and one end of the connecting rod is provided with hinge pins extending from both sides, and the other end is provided with elongated grooves on both sides.

Preferably, the connecting rod comprises two pairs of elastic arms extending toward two ends thereof respectively, and the hinge pins are respectively provided on the outer sides of two pairs of elastic arms.

Preferably, the connecting rod comprises two pairs of elastic arms extending toward two ends thereof respectively, the hinge pins at the one end of the connecting rod is provided on the outer sides of the pair of elastic arms respectively, and the elongated grooves at the other end of the connecting rod are provided in the outer sides of the other pair of elastic arms respectively.

Preferably, the extending portion is provided with a cut-out portion on at least one of two sides at the upper end thereof, and the pocket is provided with a shoulder on at least one of two sides at upper thereof, wherein the shoulder is receivable in the cut-out portion.

Further, the shape of the cut-out portion is complementary to that of the shoulder portion.

Preferably, the length of the extending portion in the direction perpendicular to the base is equal to the depth of the pocket in the same direction.

Preferably, the thickness of the extending portion is smaller than the thickness of the side plate.

The foldable container of this invention can conveniently and quickly lay the opposite side plates on the base flatly through a simple and reliable hinge structure, and it can be made into a thin-walled foldable container.

BRIEF DESCRIPTION OF THE DRAWINGS

FIGS. 9*a* to 9*c* are schematic diagrams of the folding process of the firstly folded one of a pair of opposite side plates of a foldable container according to an embodiment of the present invention, wherein FIG. 9*a* shows a schematic diagram of the firstly folded side plate in an upright position, and FIG. 9*b* shows a schematic diagram of the firstly folded side plate in an inclined position, and FIG. 9*c* shows a schematic diagram of the firstly folded side plate in a flat laid position.

FIGS. 10*a* to 10*d* are schematic diagrams of the folding process of the secondly folded side plate in a pair of opposite side plates of a foldable container according to an embodiment of the present invention, wherein FIG. 10*a* shows a schematic diagram of the secondly folded side plate in an upright position, FIG. 10*b* shows a schematic diagram of the secondly folded side plate inclined to abut against the firstly folded side plate, FIG. 10*c* shows a schematic diagram of the secondly folded side plate further inclined relative to the firstly folded side plate, and FIG. 10*d* shows a schematic diagram of the secondly folded side plate laid flat on the firstly folded side plate.

FIGS. 11*a* to 11*b* are schematic diagrams of the unfolding process of the secondly folded side plate in a pair of opposite side plates of the foldable container relative to the base according to an embodiment of the present invention, wherein FIG. 11*a* is a schematic diagram of the secondly folded side plate firstly moving away from the folded side plate, FIG. 11*b* shows a schematic diagram of the secondly folded side board being further unfolded.

DESCRIPTION OF THE INVENTION

Figure 1:
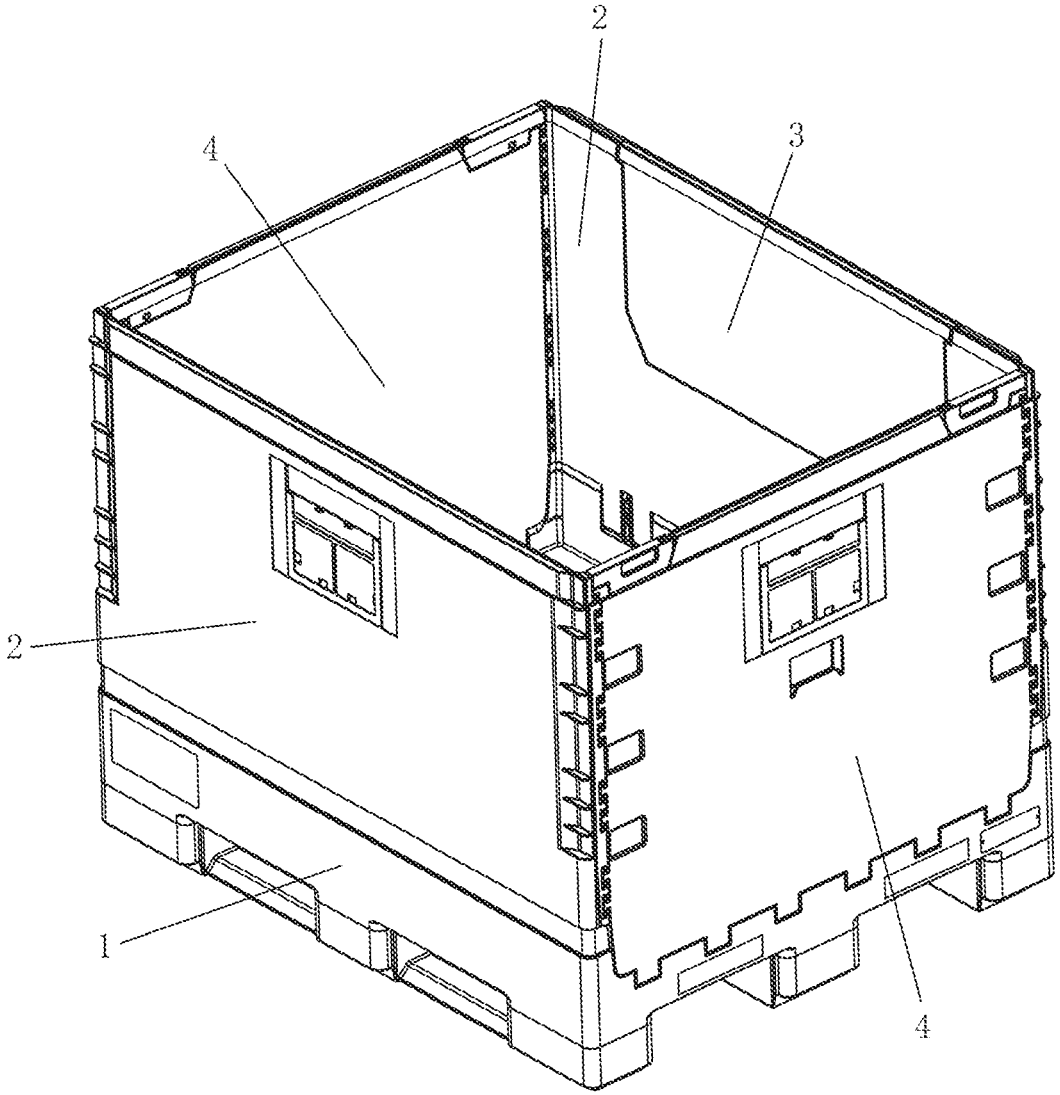
FIG. 1 is a perspective view of a foldable container according to an embodiment of the present invention.

The preferred embodiment of the present invention will be described in detail with reference to the accompanying drawings, so that the purposes, features and the advantages of the invention can be more clearly understood. It should be understood that the embodiments shown in the accompanying drawings are not intended to limit the scope of the present invention, but illustrate the essential spirit of the technical solution of the present invention.

In the following description, for purposes of illustrating the various disclosed embodiments, some specific details are set forth to provide a thorough understanding of the various disclosed embodiments. However, those skilled in the art will recognize that embodiments may be practiced without one or more of these specific details. In other instances, well-known devices, structures, and techniques associated with the present application may not be shown or described in detail to avoid unnecessarily obscuring the description of the embodiments.

Unless otherwise desired by context, throughout the description and claims, the terms "comprising" and variations thereof, such as "including" and "having", are to be construed as non-exclusive, i.e., to be construed as "including, but not limited to"

Throughout the specification "an embodiment" or "one embodiment" means that a particular feature, structure, or characteristic described in combination with the embodiment is involved in at least one embodiment. Therefore, the presence of "In one embodiment" or "in one embodiment" at various locations throughout the description need not all refer to the same embodiment. Additionally, particular features, structures, or features may be combined in any manner in one or more embodiments.

As used in the specification and appended claims, the singular forms "a" and "the" include plural references unless the context clearly dictates otherwise. The term "or" be usually used in its meaning including "and/or" unless the context clearly dictates otherwise.

In the following description, for clarity of illustration of the structure and mode of operation of the present invention, various directional terms will be used to describe the present invention, but words such as "front", "rear", "left", "right", "outer", "inner", "outward", "inward", "upper", "lower", and the like, should be understood as convenient terms and should not be construed as limiting terms.

Hereinafter, embodiments of the present invention will be described with reference to the drawings. In particular referring to FIG. 1, a foldable container 100 of the present invention that is shown, which includes a base 1 and two pairs of side plates 2 and 4. Each pair of side plates 2, 4 are hinged to the edge of the base 1 at the bottom end thereof and can be folded relative to the base 1. The side plates are connected to each other when they are erected relative to the base 1 so as to delimit the internal volume of the foldable container 100 together with the base 1. The foldable container 100 can be conveniently stored and transported when the side plates are folded relative to the base 1. One of the side plates, for example the side plate 2, is optionally provided with a small door 3 which can be pivotally opened outwardly around the hinge at the lower end thereof so that the internal volume of the foldable container 100 can be accessed by opening the small door 3.

Figure 2:
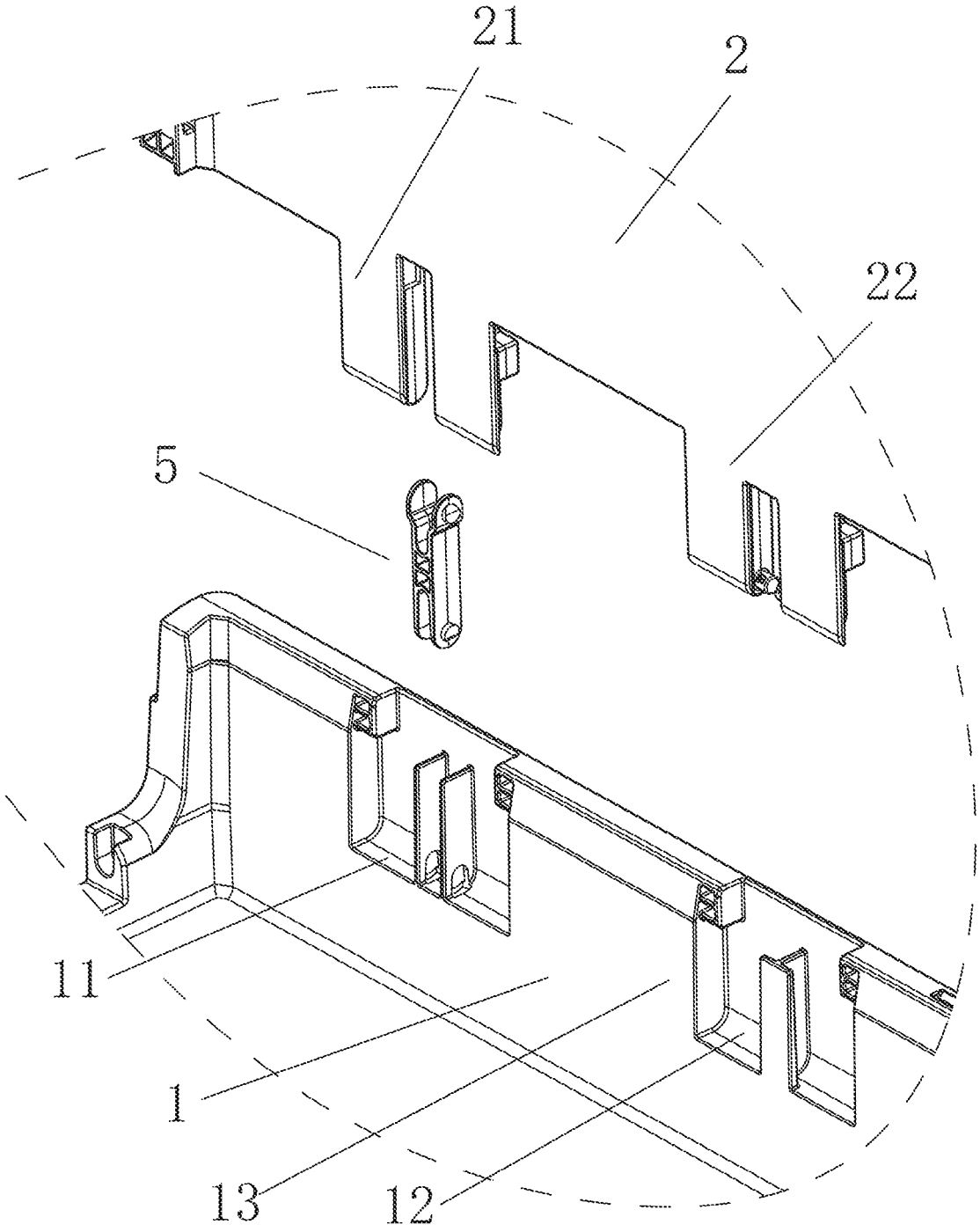
FIG. 2 is a partial exploded perspective view of a foldable container according to an embodiment of the present invention.
Figure 3:
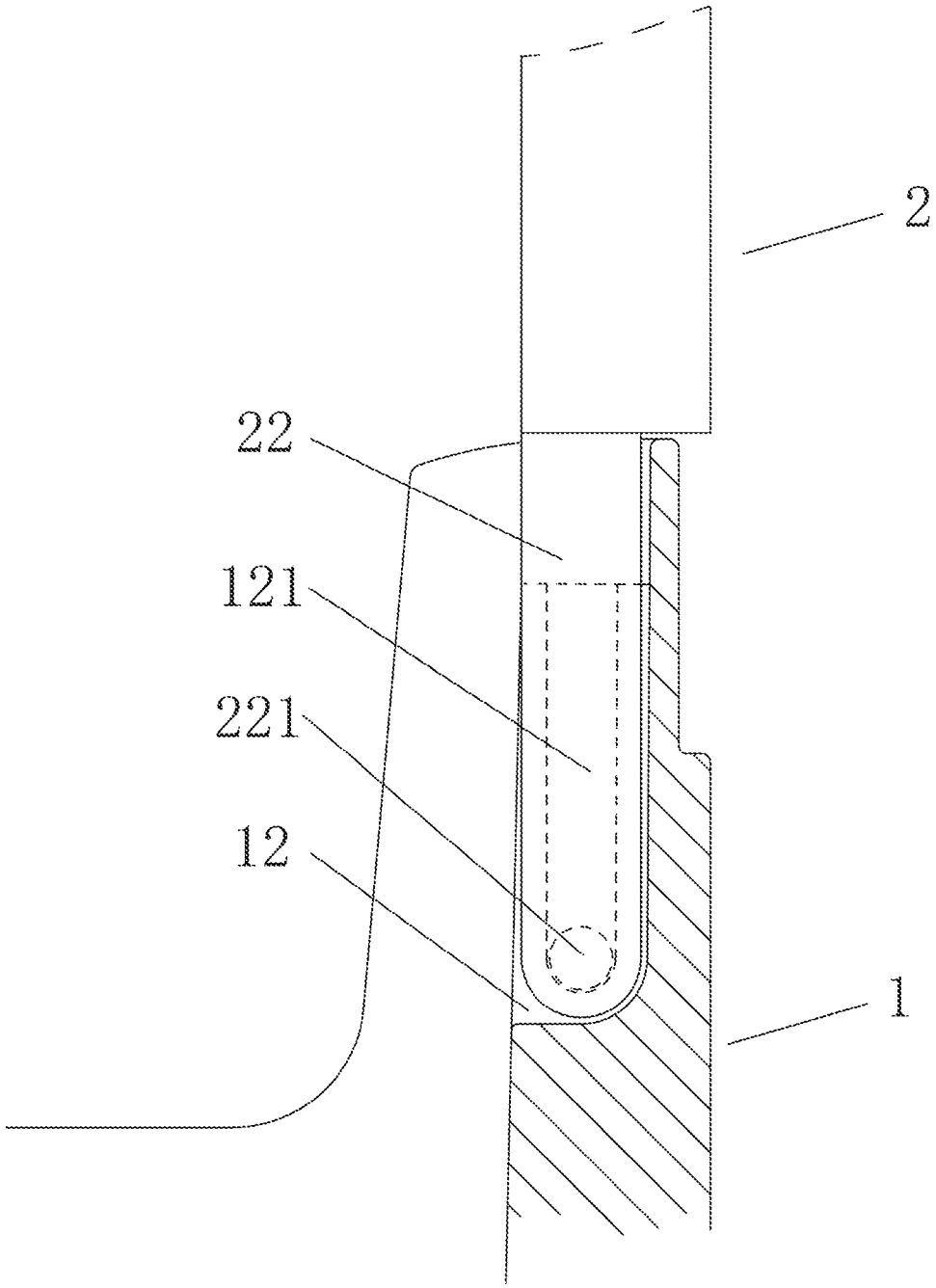
FIG. 3 is a side sectional view of a self-restoring hinge part of a foldable container according to an embodiment of the present invention.

In order to lie the side plates snugly one above another on the base 1, at least one pair of side plates of the foldable container 100 in this invention are pivotally connected to the edge of the base 1 by a rotatable self-restoring hinge structure. In the illustrated embodiment, the side plate 2 is connected to the base 1 through this hinge structure. However, it can be understood that the side plate 4 can also adopt this hinge structure. FIG. 2 shows the details of the hinge structure in a partial exploded view of the foldable container 100. In the shown embodiment, the foldable container 100 further includes a connecting rod 5. The side plate 2 is provided with extending portion 21 at the bottom edge thereof, and the base 1 is provided with a protruding portion 13 at the respective edge thereof, which extends from the base 1 upwardly and perpendicular to the base 1. The protruding portion 13 is provided with pockets 11 which open inwardly and upwardly. When the side plate 2 is erected relative to the base 1, the extending portions 21 are accommodated in the pockets 11 respectively. One end of the connecting rod 5 (the lower end in FIG. 2) is pivotally connected to the bottom end of the pocket 11, and the other end of the connecting rod 5 (the upper end in FIG. 2) and the upper end of the extending portion 21 are connected rotatably and the other end of the connecting rod 5 is slidable in the vertical direction relative to the extending portion 21. FIG. 3 shows a side cross-sectional view of the side plate 2 which is connected to the base 1 by the connecting rod 5. With this hinge structure, the secondly folded side plate of the pair of side plates 2 can be smoothly folded and placed on the firstly folded side plate and laid flatly relative to the firstly folded side plate.

FIG. 1 and FIG. 2 illustrate only one of the above-mentioned rotary self-restoring hinge structures, it should be understood that the side plate 2 can be hinged to the base 1 by a plurality of hinge structures located between the side plate 2 and the base 1. For example, as shown in FIG. 2, the side plate 2 is also provided with second extending portion 22 at the bottom edge thereof, the protruding portion 13 of the base 1 is provided with another pocket 12 correspondingly. As shown in the side view of the hinge structure in FIG. 3, the extending portion 22 is provided with a hinge pin 221, in particular on both sides of a longitudinal slot passing through the thickness of the extending portion 22. The pocket 12 is provided with two elongated grooves 121 formed on both sides of a longitudinally extending rib with a "T" shape in cross section, the hinge pin 221 can rotate and slide up-down in the grooves 121. However, it should be understood that, in addition to the hinge structure described above, the rotary self-restoring hinge structure of the present invention can be used in combination with any known hinge structure. It should be noted that although the hinge structure including the extending portion 22 and the pocket 12 is not necessary, it can provide more stable support for the side plate 2 during the rotation process and prevent the left and right movement of the side plate 2 in its unfolded and erected state. The rotating self-restoring hinge structure adopted by the extending portion 21 and the pocket 11 only needs to be arranged at two ends of the multiple extending portions of the side plate 2 to meet the functional requirements of the side plate 2.

In the above-mentioned rotary self-restoring hinge structure, it is preferably that the thickness of the protruding portion 13 is approximately the same as that of the side plate 2, which can be set below 30 mm and the connection strength of the container can still be guaranteed. It is conceivable that in some special practice, setting the thickness of the connecting rod 5 to be the same as that of the side plate 2 can further reduce the requirement on the thickness of the side plate 2. The longitudinal length of the extending portion 21 is preferably equal to or slightly smaller than the longitudinal depth of the pocket 11. Further, the thickness of the extending portion 21 is preferably smaller than the thickness of the side plate 2, and more preferably equal to or slightly smaller than the dimension of the pocket 11 in the horizontal direction. Therefore, the extending portion 21 can be accommodated in the pocket 11 and a substantially flat container inner wall is formed when the side plate 2 is erected.

Figure 4:
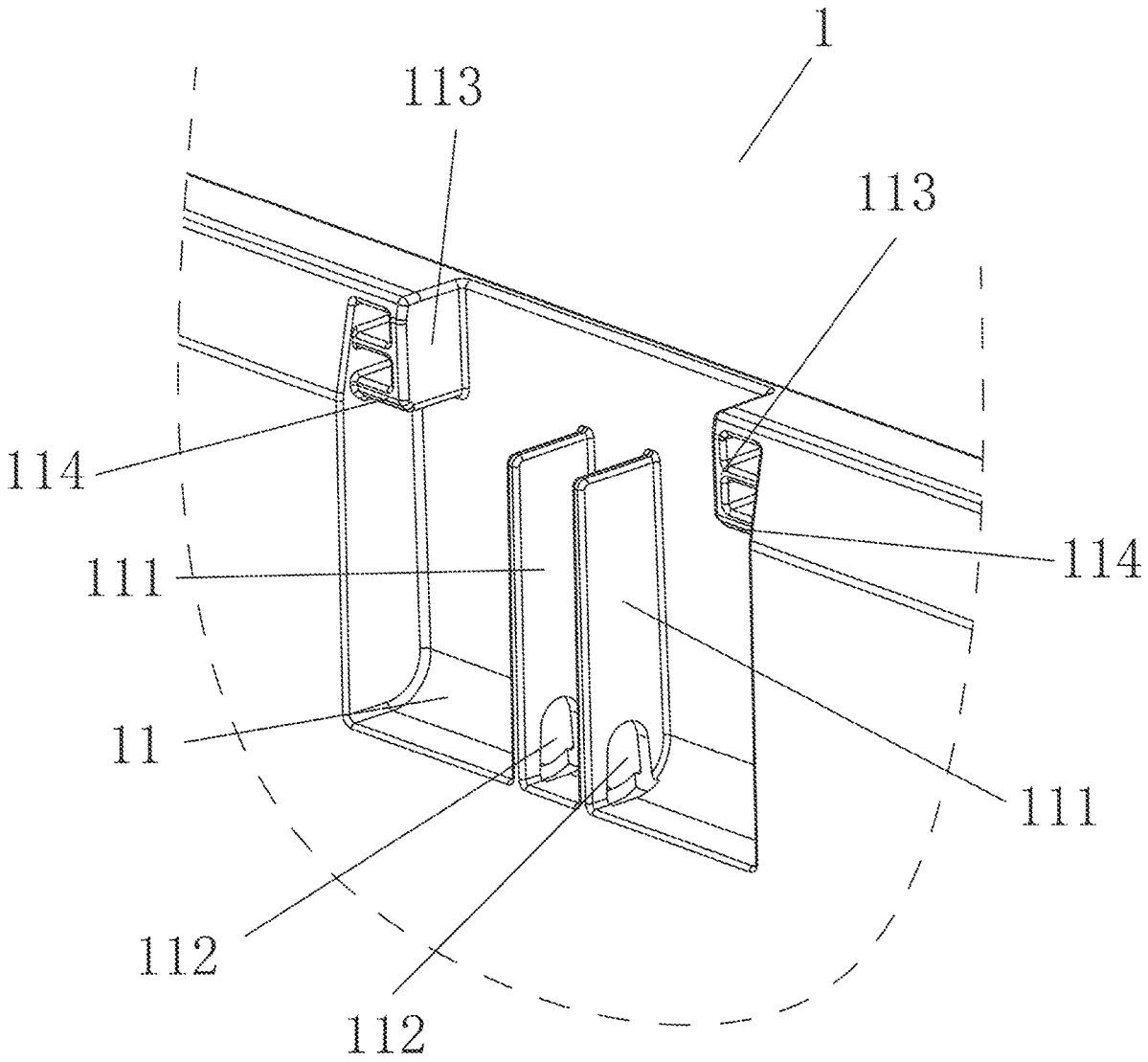
FIG. 4 is a partial enlarged view of the pocket the base of the foldable container according to an embodiment of the present invention.
Figure 5:
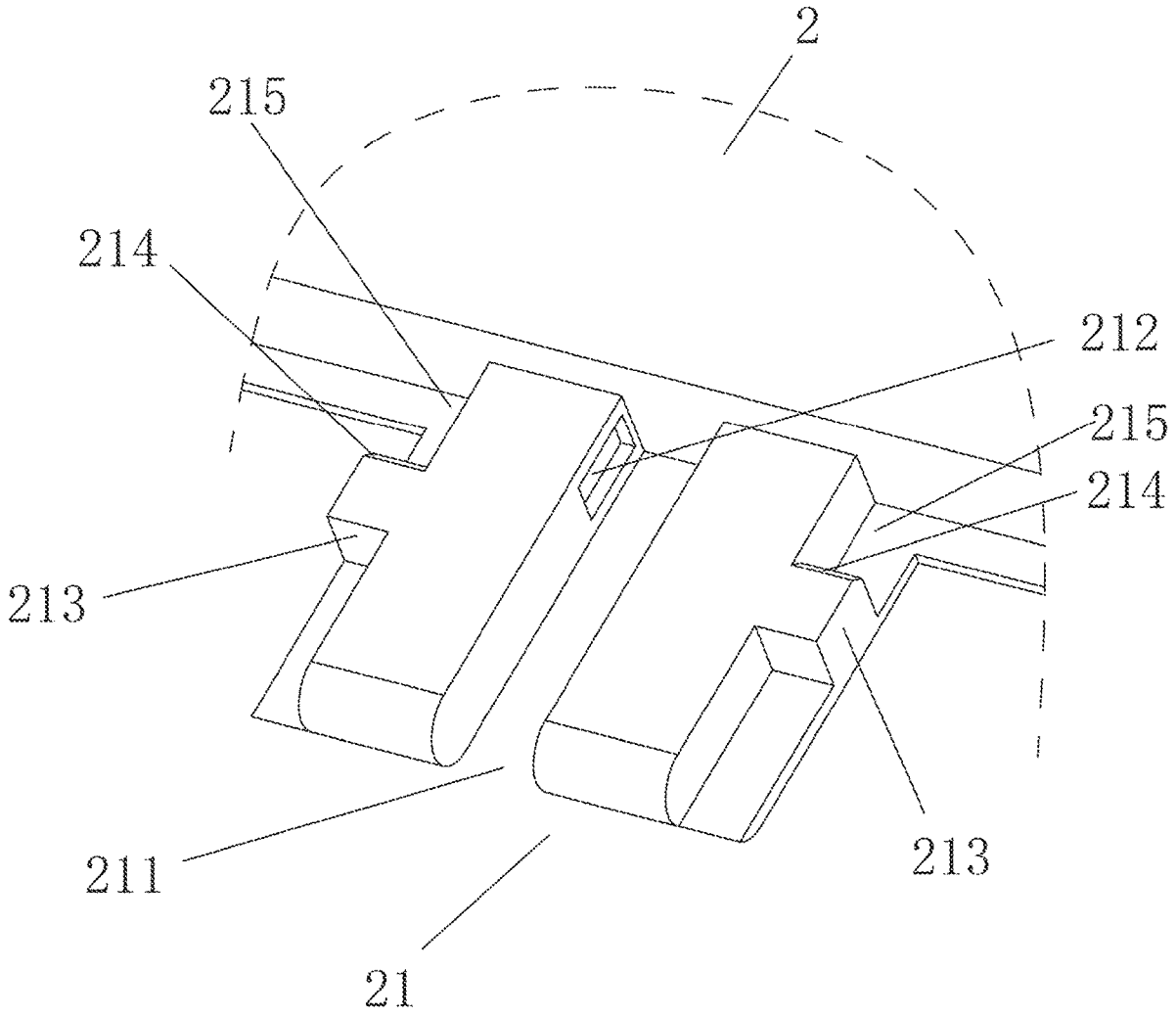
FIG. 5 is an enlarged perspective view of an extending portion of a side plate of a foldable container according to an embodiment of the present invention.

Referring to FIG. 4 and FIG. 5, in order to prevent the side plate 2 from moving upwardly relative to the base in use, that is to prevent the extending portion 21 from disengaging upwardly from the pocket 11, the extending portion 21 is provided with cut-out portions 215 (referring to FIG. 5) on both sides at the upper end thereof, and at least one of both sides at the upper end of the pocket 11 has a shoulder 113

(referring to FIG. 4) which can be accommodated in the cut-out portion 215. The shape of the cut-out portion 215 is preferably complementary to that of the shoulder 113, thus the shoulder 113 can be placed in the cut-out portion 215 when the side plate 2 is erected. The extending portion 21 is provided with a hanging platform 213 which is adjacent to and located below the cut-out portion 215, as shown in FIG. 5. In FIG. 5, the longitudinal length of the hanging platform 213 is only illustrative and can be varied as required. Preferably, a guiding inclined surface 214 is provided at the position adjacent to the cut-out portion 215 of the hanging platform 213, and a guiding inclined surface 114 is provided on the lower edge of the shoulder 113, so that the hanging platform 213 can engage with the shoulder 113 more smoothly during the process of the side plate 2 being erected from the folded state, and thus the side plate 2 can be more smoothly seated. FIG. 4 and FIG. 5 show an embodiment in which the extending portion 21 and the pocket 11 are respectively provided with a pair of cut-out portions 215 and a pair of shoulders 113. However, it should be understood that only one cut-out portion 215 and a corresponding the shoulder 113 can also achieve the effects of preventing the extending portion 21 disengaging upwardly from the pocket 11 and facilitating the side plate 2 to be more smoothly seated during the erection process.

Furthermore, still referring to FIG. 4 and FIG. 5, to facilitate connecting to the connecting rod 5, the extending portion 21 is provided with a longitudinal slot 211 passing through the thickness thereof, and the pocket 11 is provided with a pair of longitudinal ribs 111. The width between the surfaces facing away from each other of the pair of longitudinal ribs 111 is less than or equal to the width of the longitudinal slot 211, thus the pair of longitudinal ribs 111 will be received in the longitudinal slot 211 when the extending portion 21 is located in the pocket 11. The lower end of the longitudinal rib 111 is hinged with the lower end of the connecting rod 5, and the upper end of the longitudinal slot 211 is slidably and rotatably connected to the upper end of the connecting rod 5. In particular, for example, in the embodiment shown in FIGS. 1-6, the longitudinal slot 211 is provided with elongated grooves 212 on opposite sides at the upper end thereof, and the connecting rod 5 is provided with hinge pins 54 extending from opposite sides (referring to FIG. 6) at the upper end which can be installed in the elongated groove 212 and slide and rotate therein. In another embodiment shown in FIG. 7, the longitudinal slot 211 is provided with hinge pins 217 at the upper end thereof which is provided on opposite sides thereof, and the connecting rod 5 is provided with elongated grooves 56 on the opposite sides at the upper end thereof in which the hinge pins 217 can be installed and the hinge pins 217 can slide and rotate therein. Besides, a pair of longitudinal ribs 111 is provided with hinge holes 112 at the lower end thereof, and the connecting rod 5 is provided with a hinge pin 52 extending from both sides at the lower end thereof (referring to FIG. 6) which can be installed and rotate in the hinge hole 112. Certainly, it is also conceivable that the pair of longitudinal ribs 111 can be provided with hinge pins at the lower ends thereof and the connecting rod 5 can be provided with hinge holes on both sides at the lower end thereof. The hinge pin 52, 54 or 217 can be provided with a guiding slope to facilitate installation. In the illustrated embodiment, only one longitudinal slot 211 is provided in the extending portion 21 and only a pair of the longitudinal ribs 111 is provided in the pocket 11, and they are connected by one connecting rod 5. However, it can be appreciated that more than one of longitudinal slots 211 can be provided in one extending portion 21 and corresponding pairs of longitudinal ribs 111 can be provided in the pocket 11, and they are connected by a corresponding number of the connecting rods 5.

Figure 6:
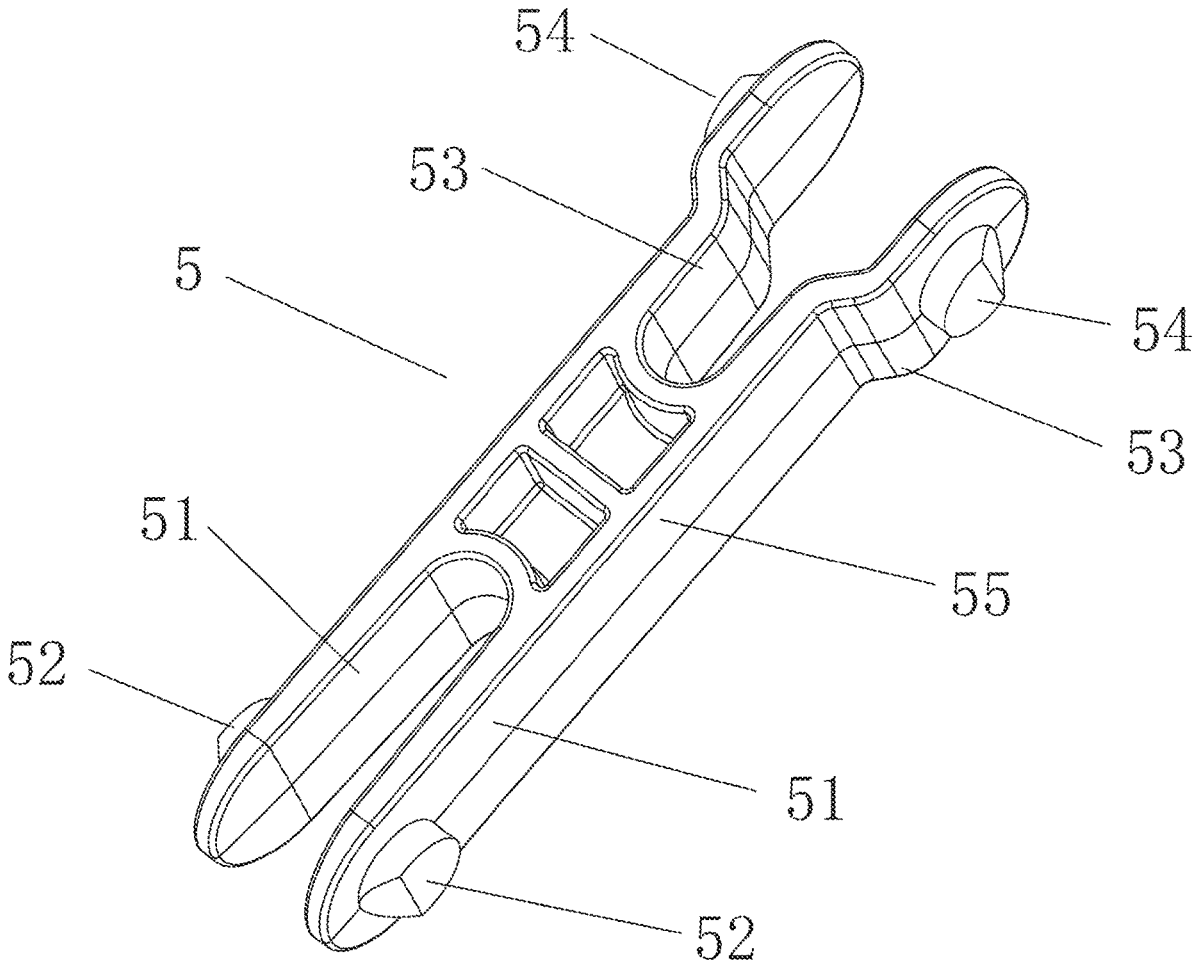
FIG. 6 is a perspective view of a connecting rod of a self-restoring hinge of a foldable container according to an embodiment of the present invention.
Figure 7:
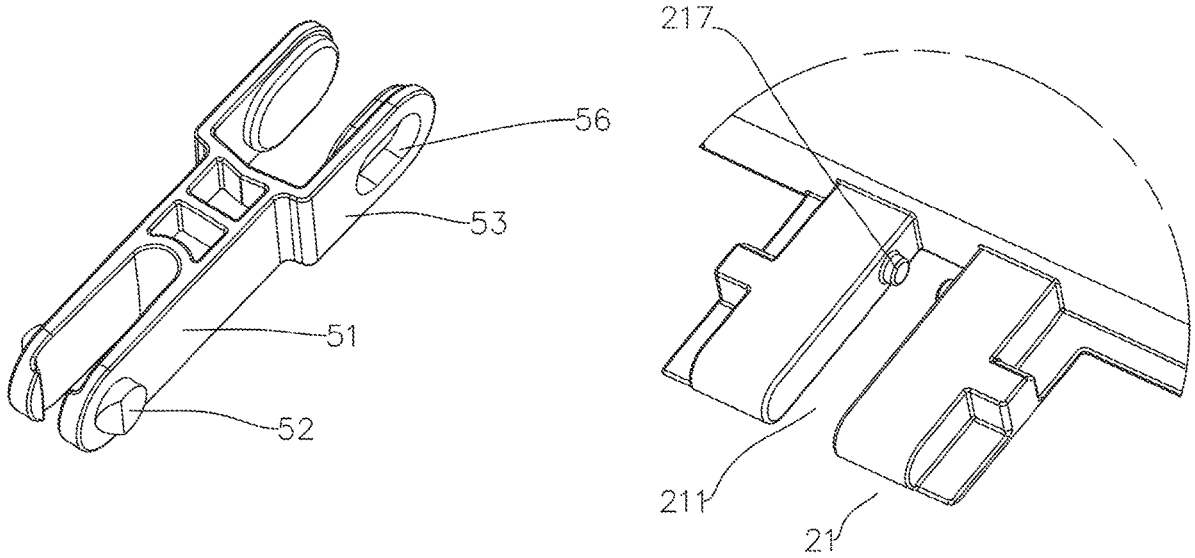
FIG. 7 is a perspective view of an extending portion and a connecting rod of a self-restoring hinge of a foldable container according to another embodiment of the present invention.

FIG. 6 illustrate a perspective view of the connecting rod 5 which includes a middle segment 55, a pair of elastic arms 51 extending downwardly from the middle section 55 and a pair of elastic arms 53 extending upwardly therefrom. The hinge pins 52 are provided on the outer sides of the elastic arm 51 respectively and the hinge pins 54 are provided on both sides of the elastic arm 53 respectively. The connecting rod 5 is generally made of plastic material which impart it elasticity, thus it can be detachably connected to the extending portion 21 and the pocket 11. However, it can be appreciated that the connecting rod 5 can also adopt other structures, as long as it can form a hinged connection with the pocket 11 at the lower end thereof and a sliding rotation connection with the extending portion 21 at the upper end thereof.

Figure 8:
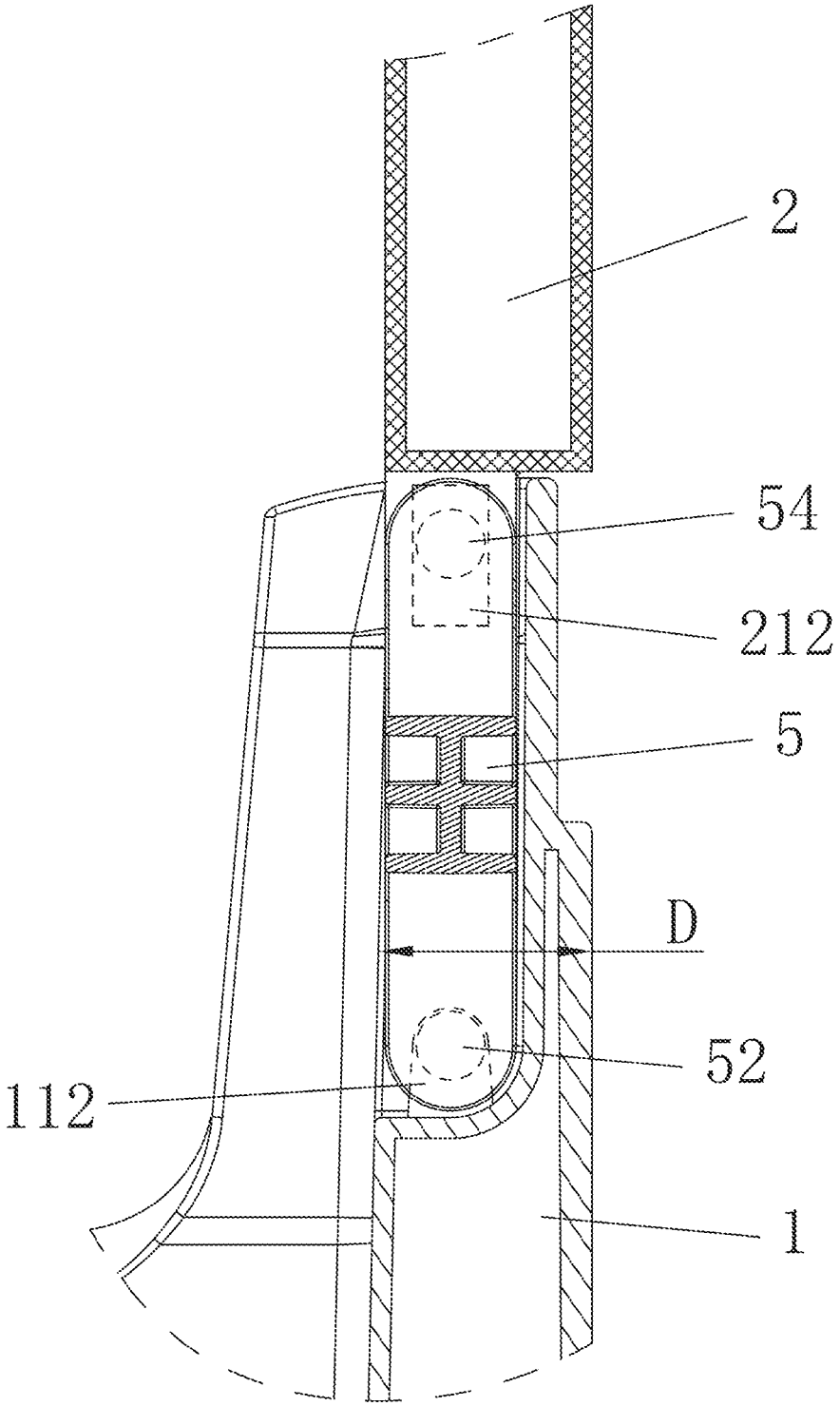
FIG. 8 is a cross-sectional view of the self-restoring hinge part of the foldable container taken along the longitudinal center plane of the connecting rod according to an embodiment of the present invention.

FIG. 8 shows a side sectional view taken along the connecting rod 5 after the connecting rod 5 is assembled with the extending portion 21 and the pocket 11. In FIG. 8, the side plate 2 is in the erected state, the hinge pin 52 is received in the hinge hole 112 and the hinge pin 54 is received in the elongated slot 212. The dimension D shown in the figure is the thickness of the protruding portion 13 of the base 1 which is approximately equal to the thickness of the side plate 2.

In the above embodiment, the longitudinal slot 211 is provided in the middle of the extending portion 21, and a pair of the longitudinal ribs 111 is provided in the middle of the pocket 11, and they are connected to each other by the connecting rod 5. However, it should be understood that the extending portion 21 may not be provided with the longitudinal slot 211, and the pocket 11 may not be provided with a pair of ribs 111. Alternatively, the elongated grooves 212 are provided on both sides of the extending portion 21, the hinge holes 112 are provided on both sides of the pocket 11, and two gaps for accommodating two connecting rods 5 is formed between the two sides of the extending part 21 and the two sides of the pocket part 11 respectively. In this case, the connecting rod is only provided with one hinge pin at each of the upper end and the lower end thereof.

Figure 9A:
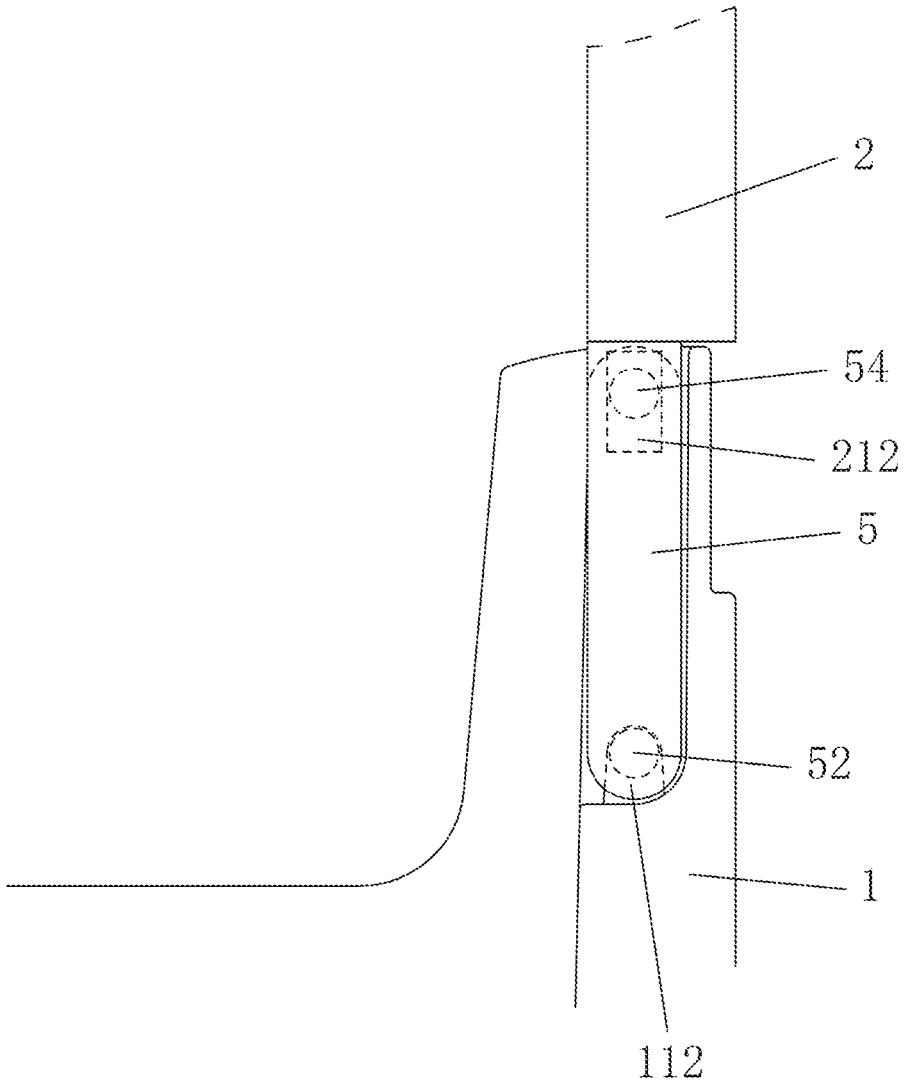
Figure 9B:
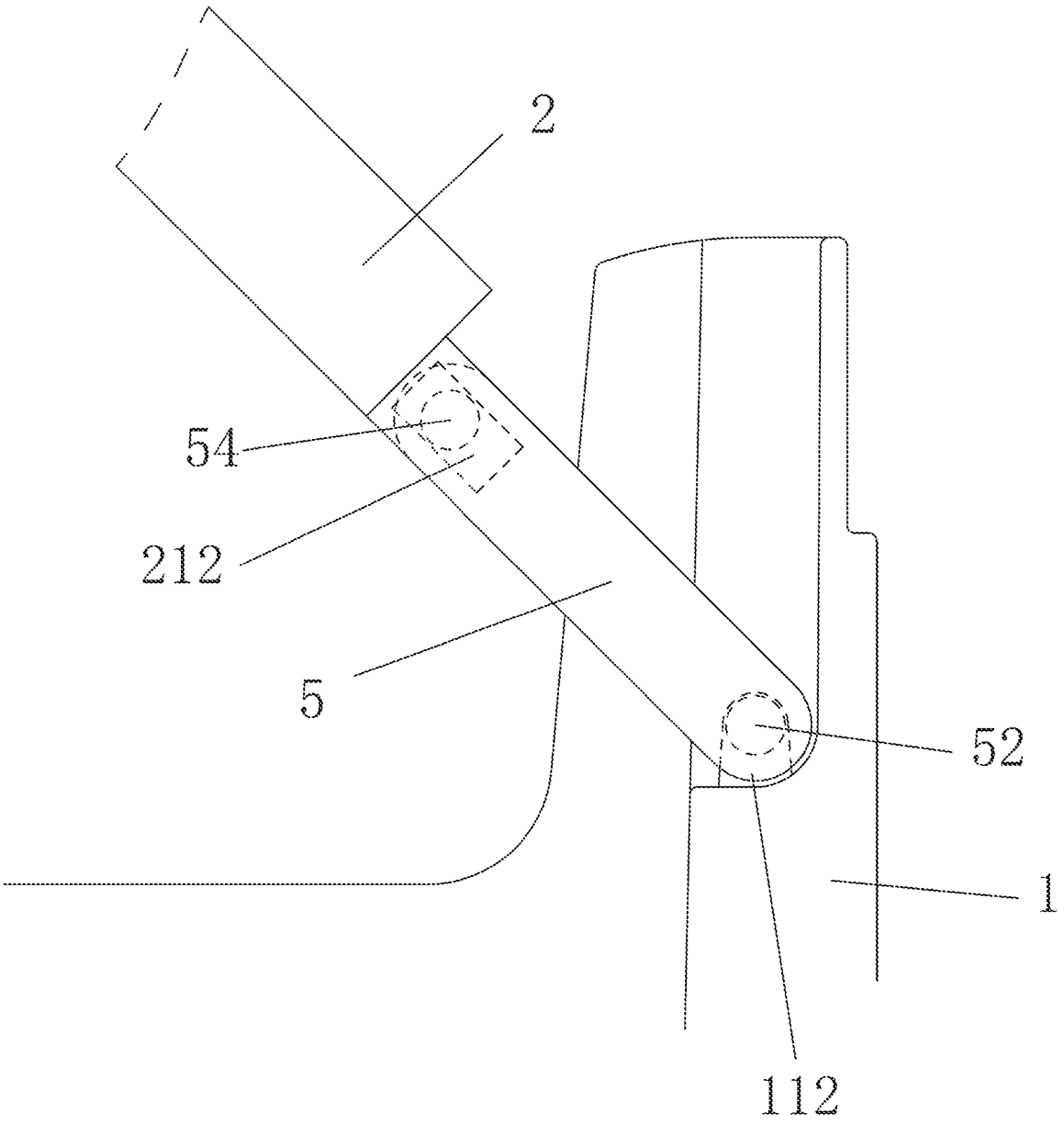
Figure 9C:
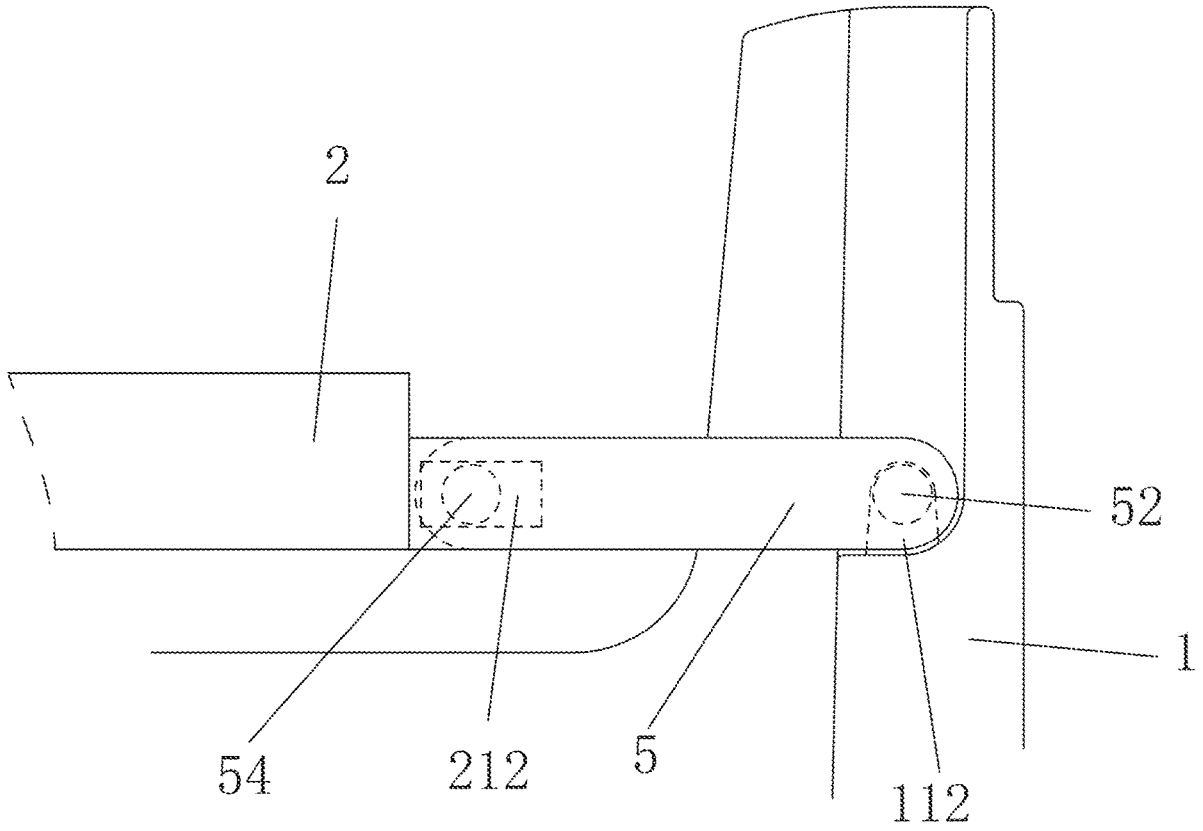

FIGS. 9*a*-9*c* show the folding process of the firstly folded side plate of the opposite pair of side plates 2, and FIG. 9*a* shows a schematic diagram of the firstly folded side plate in the erected position, in which the axis of the hinge pin 52 of the connecting rod 5 coincides with that of the hinge pin 221 on the extending portion 22 of the side plate 2. When the side plate 2 starts to be folded, the above axis is the only rotation axis of the side plate 2 (referring to FIGS. 9*b* and 9*c*), which is the same when the side plate is unfolding.

Figure 10A:
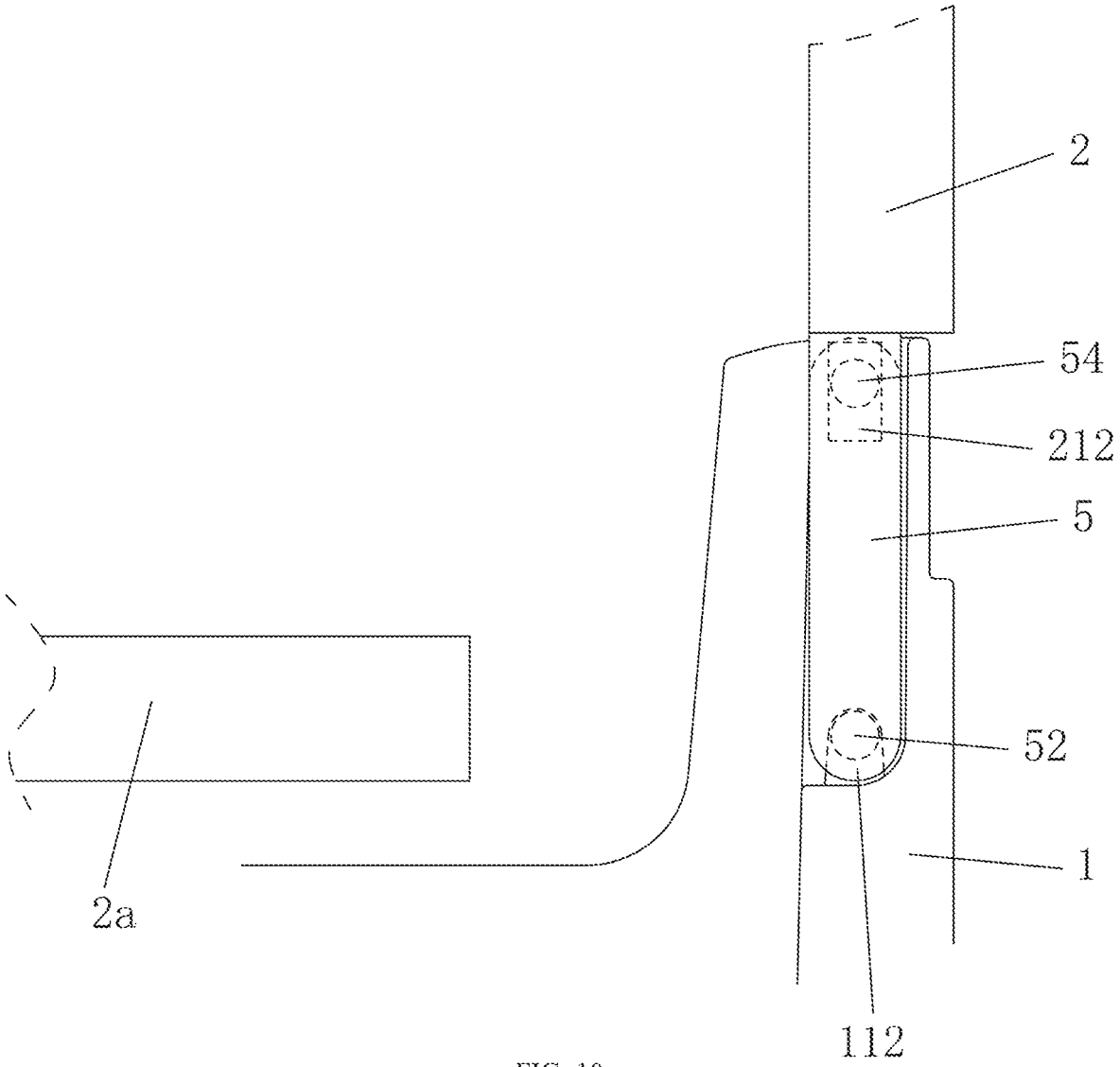
Figure 10B:
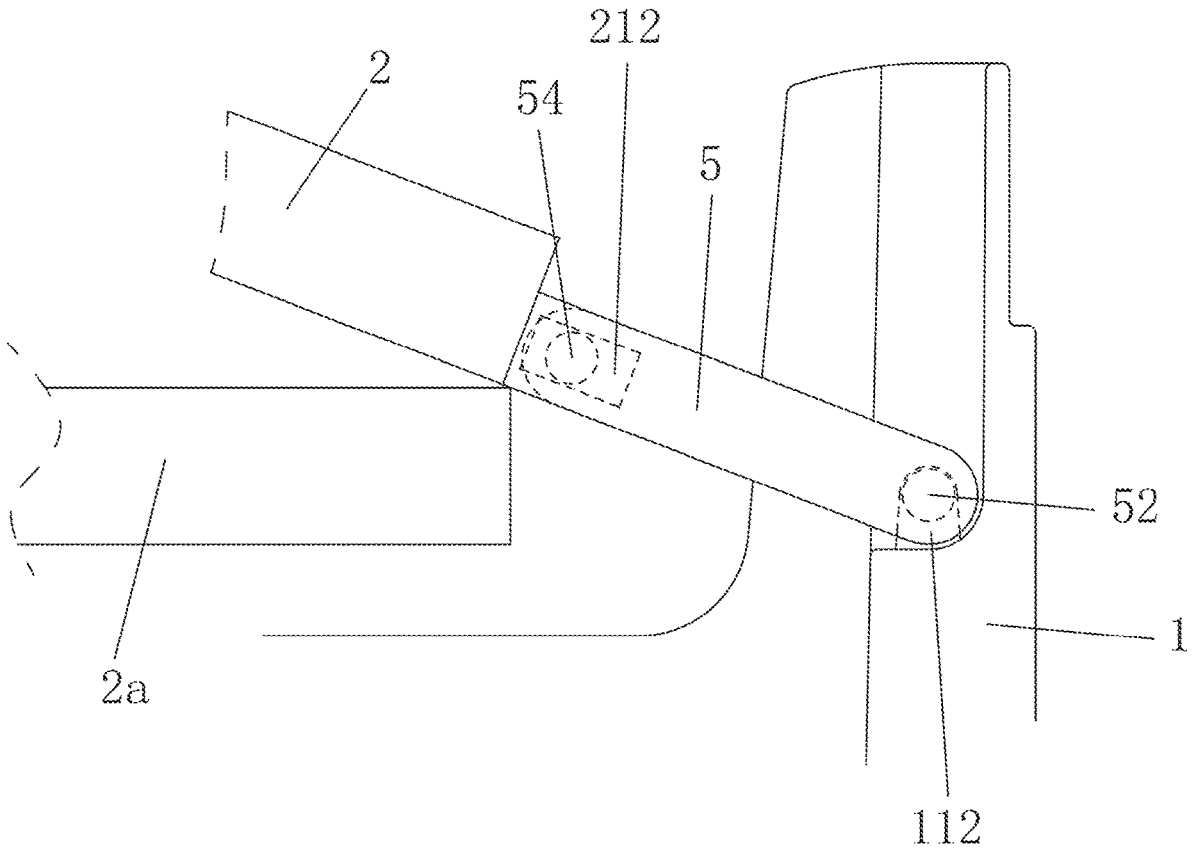
Figure 10C:
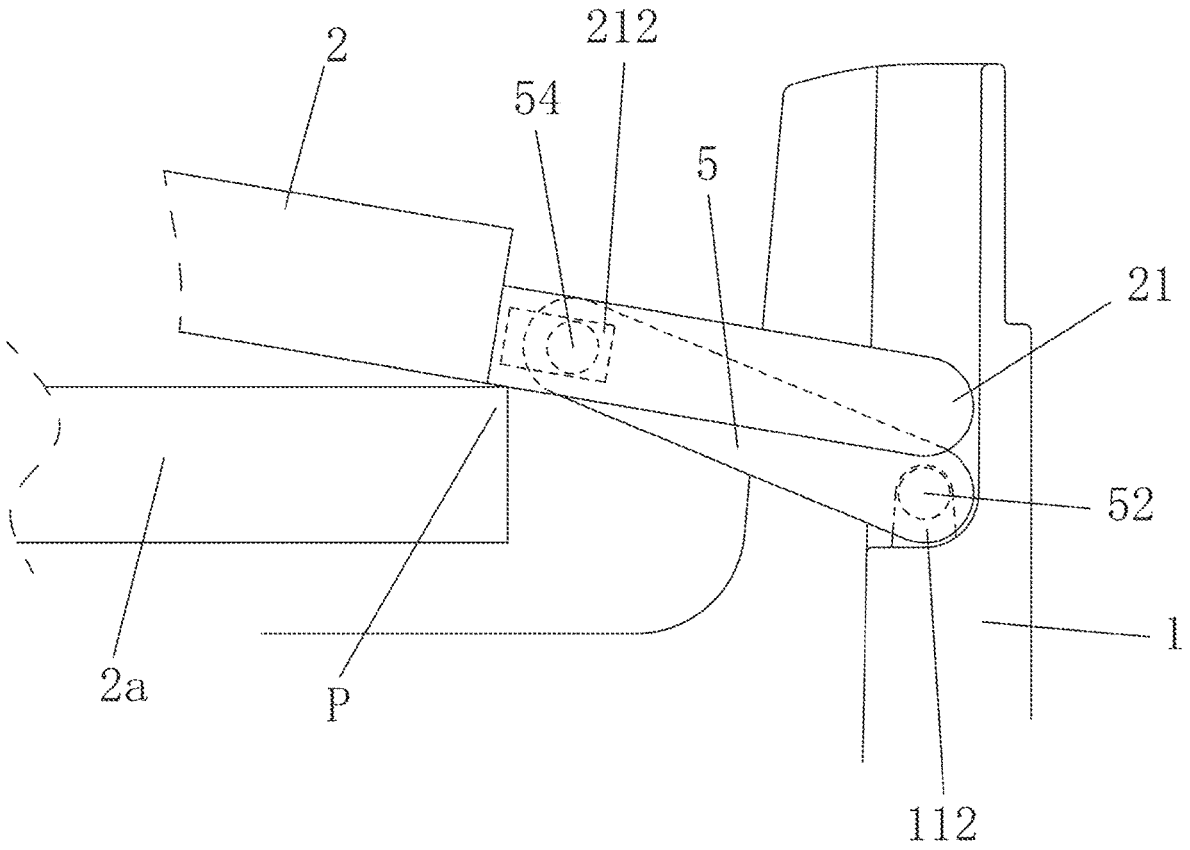
Figure 10D:
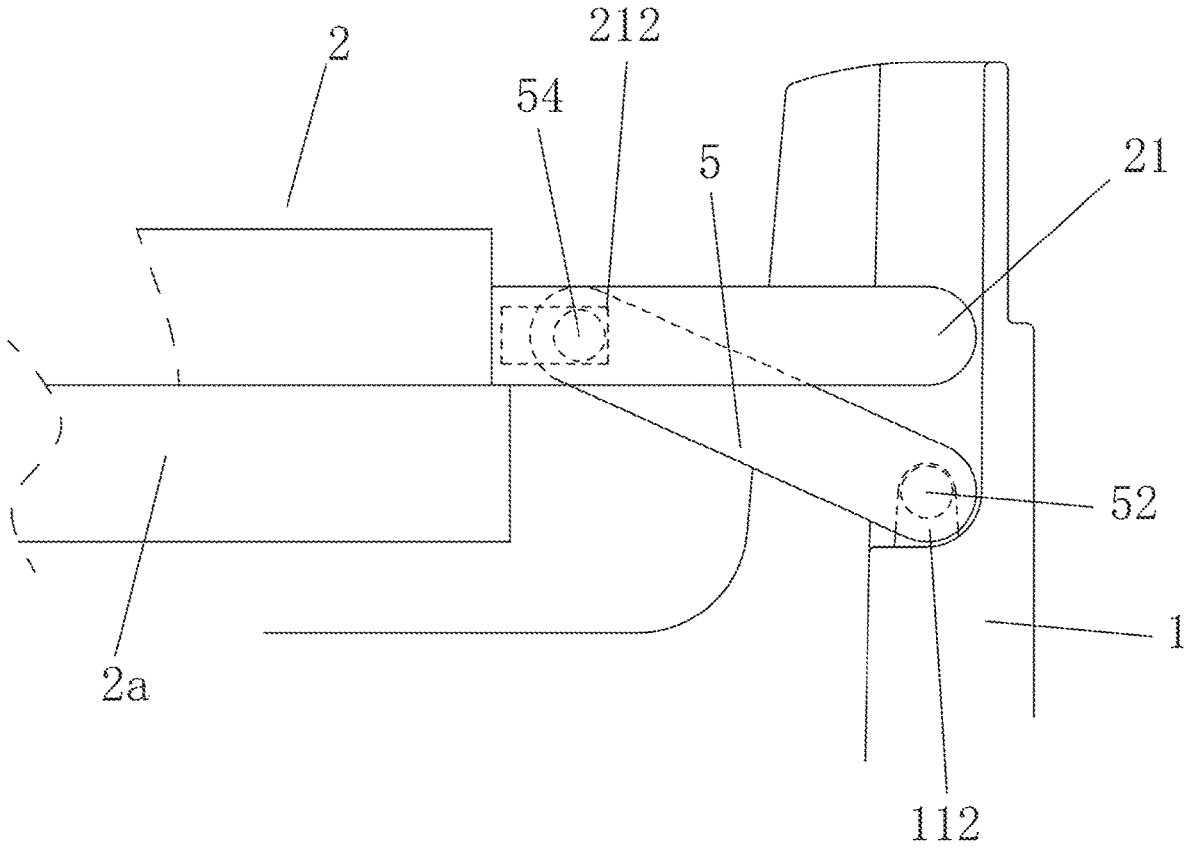

FIGS. 10*a*-10*d* show the folding process of the secondly folded side plate in the opposite pair of side plates 2. FIG. 10*a* shows a schematic diagram of the secondly folded side plate in the erected position. When the side plate 2 starts to be folded, the side plate 2 rotates at first around the axis of the hinge pin 52 and once it touches the opposite firstly folded side plate (see FIG. 10*b*), it then starts to rotate around the contact point P which functions as a fulcrum (shown in FIG. 10*c*). Meanwhile, the lower end of the extending portion 21 is moved upwardly and away from the side wall of the pocket 11, and the hinge pin 221 of the extending portion 22 also is moved upwardly. Preferably, the width of the groove 121 is greater than the diameter of the hinge pin 221 to match the movement trajectory of the extending portion 21, thereby allowing the hinge pin 221 to move by a distance horizontally in the groove 121. Meanwhile, the hinge pin 54 of the connecting rod 5 also starts to move toward the lower end of the elongated grooves 212 in the case of the embodiment shown in FIGS. 5-6, while in the case of the embodiment shown in FIG. 7, the hinge pin 217 starts to move toward the lower end of the elongated groove 56, and the hinge pin 54/217 is located at the lowest end of the elongated groove 212/56 when the side plate 2 is folded to be completely parallel to the opposite side plate 2, then the connecting rod 5 restricts the extending portion 21 of the side plate 2 from moving upward and leftward to guarantee safety and stability of the side plate 2 when the container is folded.

Figure 11A:
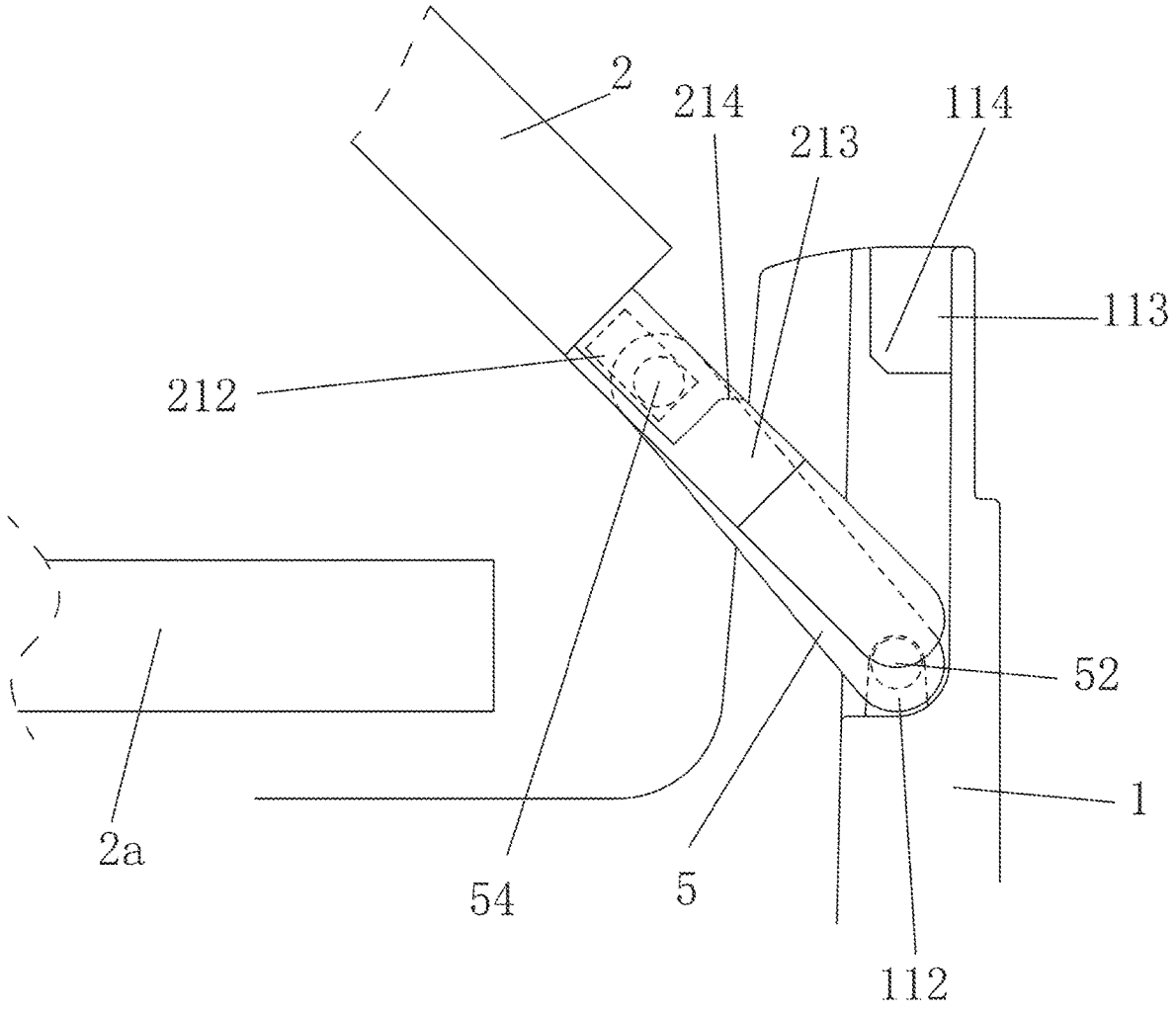
Figure 11B:
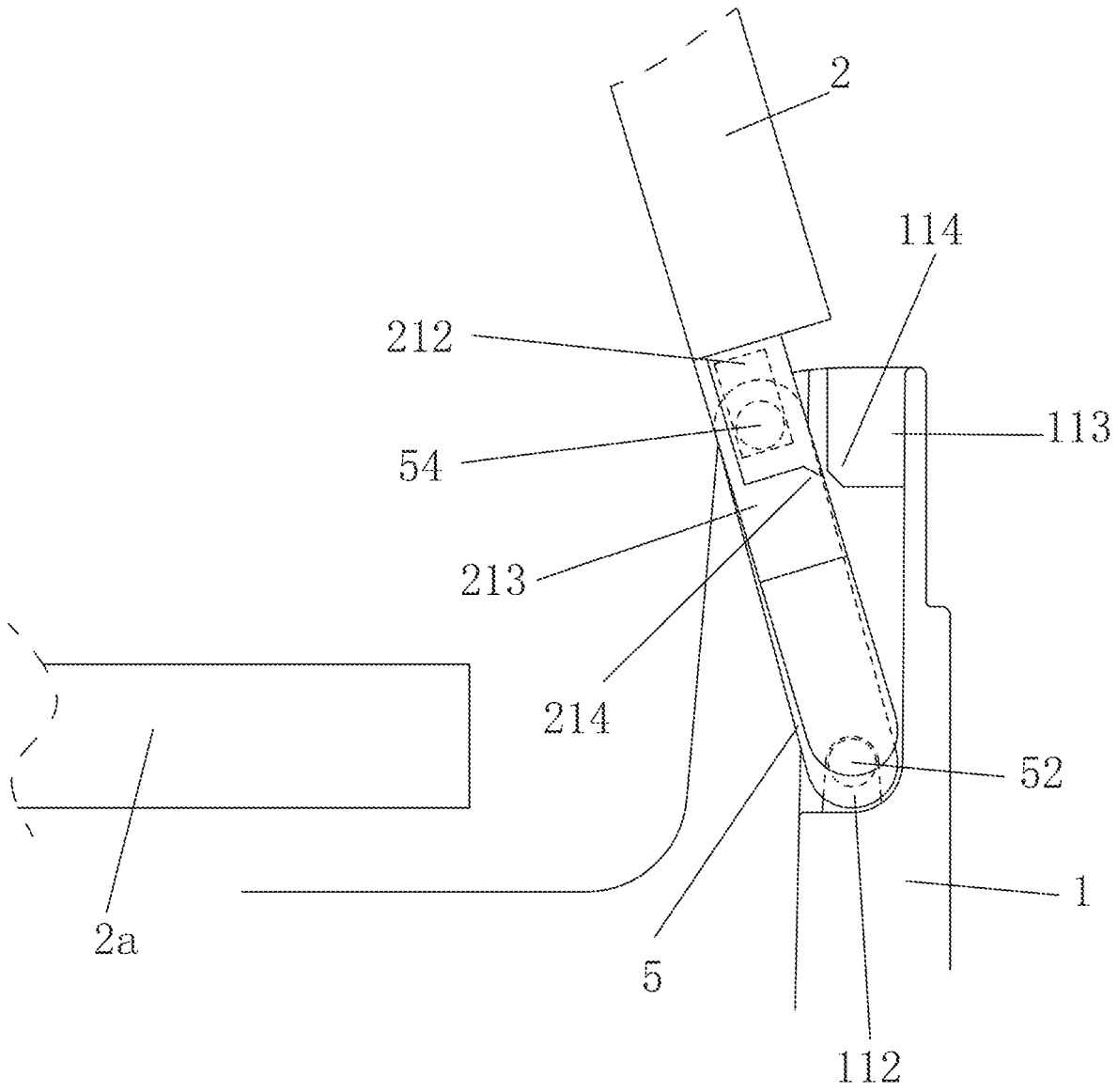

FIGS. 11*a*-11*b* show the folding process of the secondly folded side plate in the opposite pair of side plates 2. As shown in FIG. 11*a*, the side plate 2 rotates around the hinge pin 54, meanwhile the connecting rod 5 rotates around the hinge pin 52, then the lower end of the extending portion 21 of the side plate 2 rotates downwardly, but due to friction, the hinge pin 54/217 does not necessarily move up to the upper part of the elongated groove 212/56 because of the gravity of the side plate 2. In this case, the inclined surfaces 114, 214 guide the hanging platform 213 and the shoulder 113 into the correct matching position when the side plate 2 rotates to unfold until the hanging platform 213 of the side plate 2 and the shoulder 113 of the base 1 contact each other. During this process, the side plate 2 moves downwardly accordingly and the hinge pins 54/217 move upward along the elongated grooves 212/56 to the upper part thereof so that the entire operation is smooth.

The preferred embodiments of the present invention have been described in detail above, but it should be understood that, if necessary, aspects of the embodiments can be modified to adopt aspects, features, and concepts of various patents, applications, and publications to provide additional embodiments.

Considering the detailed description above, these and other variations can be made to the embodiments. Generally, in the claims, the terms used should not be construed as limiting the specific embodiments disclosed in the description and claims, but should be construed to include all possible embodiments together with all equivalents to which these claims entitled.

What is claimed is:

1. A foldable container comprising:

a base;

two pairs of side plates which are hinged to edges of the base respectively and is foldable relative to the base; and a connecting rod;

wherein lower edges of at least one pair of the two pairs of side plates are provided with extending portions, and corresponding edges of the base are provided with protruding portions extending perpendicular to the base, wherein the protruding portions are provided with pockets opening toward the inside of the foldable container and the upper end of the protruding portion; and one end of the connecting rod is pivotally connected to the bottom end of the pocket, and the other end is rotatably connected to the upper end of the extending portion and is slidable in a height direction of the extending portion.

2. The foldable container according to claim 1, wherein each of the extending portions is provided with a longitudinal slot passing through the thickness thereof and opening toward the bottom end thereof, and the other end of the connecting rod is slidably and rotatably connected to the upper end of the longitudinal slot.

3. The foldable container according to claim 1, wherein the foldable container has a plurality of the extending portions spaced apart from each other, a plurality of the pockets spaced apart from each other, and a plurality of connecting rods.

4. The foldable container according to claim 3, wherein the lower edge of at least one of the two pairs of side plates is further provided with an additional extending portion, and the protruding portion is further provided with an additional pocket opening toward the inside of the foldable container and the upper end of the protruding portion, wherein the additional extending portion is slidably and rotatably connected to the additional pocket.

5. The foldable container according to claim 4, wherein the additional extending portion is provided with an additional longitudinal slot passing through the thickness thereof and opening toward the bottom end thereof, wherein hinge pin is provided on each of both sides of the bottom end of the additional longitudinal slot respectively; the additional pocket is provided with two elongated opening grooves which are formed on both sides thereof by a longitudinally extending rib with a "T" shape in cross section, wherein the hinge pins are respectively received in the two elongated opening grooves.

6. The foldable container according to claim 1, wherein the extending portion is provided with a longitudinal slot passing through the thickness thereof and opening toward the bottom end thereof, and the pocket is provided with a corresponding pair of longitudinal ribs;

the width between the surfaces facing away from each other of the pair of longitudinal ribs is less than or equal to the width of the longitudinal slot;

the lower ends of the longitudinal ribs are hinged with the one end of the connecting rod and the upper end of the longitudinal slot is slidably and rotatably connected to the other end of the connecting rod.

7. The foldable container according to claim 6, wherein the lower ends of the pair of longitudinal ribs are provided with hinge holes respectively, and the one end of the connecting rod is provided with hinge pins extending from both sides thereof.

8. The foldable container according to claim 6, wherein the longitudinal slot is provided with elongated grooves on both sides at the upper end thereof, and the other end of the connecting rod is provided with hinge pins extending from both sides thereof.

9. The foldable container according to claim 6, wherein the longitudinal slot is provided with hinge pins on both sides at the upper end thereof, and the other end of the connecting rod is provided with elongated grooves on both sides.

10. The foldable container according to claim 9, wherein the connecting rod comprises two pairs of elastic arms extending toward two ends thereof respectively, and the hinge pins are respectively provided on the outer sides of the two pairs of elastic arms.

11. The foldable container according to claim 6, wherein the lower ends of the pair of longitudinal ribs are provided with hinge holes, the longitudinal slot are provided with elongated grooves on both sides at the upper end thereof respectively, and both ends of the connecting rod are provided with hinge pins extending from both sides thereof.

12. The foldable container according to claim 6, wherein the lower ends of the pair of longitudinal ribs are provided with hinge holes, and the upper end of the longitudinal slot is provided with hinge pins on both sides at the upper end thereof respectively; and the one end of the connecting rod is provided with hinge pins extending from both sides, and the other end is provided with elongated grooves on both sides.

13. The foldable container according to claim 12, wherein the connecting rod comprises two pairs of elastic arms extending toward two ends thereof respectively, the hinge pins at the one end of the connecting rod is provided on the outer sides of the one pair of elastic arms respectively, and the elongated grooves at the other end of the connecting rod are provided in the outer sides of the other pair of elastic arms respectively.

14. The foldable container according to claim 1, wherein the extending portion is provided with a cut-out portion on at least one of two sides at the upper end thereof, and the pocket is provided with a shoulder on at least one of two sides at upper thereof, wherein the shoulder is receivable in the cut-out portion.

15. The foldable container according to claim 14, wherein the shape of the cut-out portion is complementary to that of the shoulder.

16. The foldable container according to claim 1, wherein the length of the extending portion in the direction perpendicular to the base is equal to the depth of the pocket in the same direction.

17. The foldable container according to claim 1, wherein the thickness of the extending portion is smaller than the thickness of the side plate.

* * * * *